US006871512B2

(12) United States Patent
Tsunoda

(10) Patent No.: US 6,871,512 B2
(45) Date of Patent: Mar. 29, 2005

(54) MOTOR-DRIVEN COMPRESSOR

(75) Inventor: Masataka Tsunoda, Isesaki (JP)

(73) Assignee: Sanden Corporation, Gunma (JP)

( * ) Notice: Subject to any disclaimer, the term of this patent is extended or adjusted under 35 U.S.C. 154(b) by 0 days.

(21) Appl. No.: 10/721,103

(22) Filed: Nov. 26, 2003

(65) Prior Publication Data

US 2004/0118149 A1 Jun. 24, 2004

(30) Foreign Application Priority Data

Dec. 5, 2002 (JP) ..... 2002-354054

(51) Int. Cl.[7] ..... F25B 31/00; F04B 17/00

(52) U.S. Cl. ..... 62/505; 417/367; 417/368; 417/371

(58) Field of Search ..... 62/505, 469, 498; 417/368, 366, 269, 357, 371, 372, 419, 902

(56) References Cited

U.S. PATENT DOCUMENTS 6,565,329 B2 * 5/2003 Yokomachi et al. ..... 417/269

6,634,870 B2 * 10/2003 Dreiman et al. ..... 417/368

FOREIGN PATENT DOCUMENTS

JP 2001193639 7/2001

* cited by examiner

*Primary Examiner*—Chen Wen Jiang
(74) *Attorney, Agent, or Firm*—Baker Botts L.L.P.

(57) ABSTRACT

A motor-driven compressor for compressing a refrigerant in an air conditioning system includes an electric motor, a swash plate-type compression unit driven by the electric motor, and a cooling channel for returning the refrigerant used by the air conditioning system to a suction chamber of the compression unit. The cooling channel has an upstream section including an armature chamber of the electric motor, and a downstream section extending from the armature chamber to the suction chamber in such a manner that the downstream section is separated from a crank chamber of the compression unit.

11 Claims, 4 Drawing Sheets

MOTOR-DRIVEN COMPRESSOR

This nonprovisional application claims priority under 35 U.S.C. 119(a) on Patent Application No. 2002-354054 filed in Japan on Dec. 5, 2002, the entire contents of which are incorporated herein by reference.

BACKGROUND OF THE INVENTION

1. Field of the Invention

The present invention relates to a motor-driven compressor incorporated in an automotive air conditioning system.

2. Description of the Related Art

An air conditioning system for a motor vehicle includes a compressor for compressing a refrigerant and discharging the resultant high-pressure refrigerant. The high-pressure refrigerant is used to cool the interior of the vehicle compartment of the motor vehicle. More specifically, the high-pressure refrigerant is liquefied by a condenser and then evaporated in an evaporator to cool the air which is introduced into the vehicle compartment.

As such compressor, a motor-driven compressor directly coupled with an electric motor is known. The motor-driven compressor includes an electric motor and a compression unit driven by the electric motor, and the compression unit has a swash plate-type compression mechanism, for example, built therein.

In the height of summer, the air conditioning system is required to provide high cooling power and the electric motor of the motor-driven compressor is operated at high speed for a long time. In such cases, the quantity of heat generated by the electric motor greatly increases, so that the ambient atmosphere of the electric motor is heated to an extremely high temperature. As a result, the rotation efficiency of the electric motor lowers, making the air conditioning system unable to provide the required cooling power.

To eliminate the drawback, a motor-driven compressor disclosed in Japanese Patent Application Publication No. 2001-193639 is provided with a built-in cooling circuit, and the cooling circuit allows part of the suction refrigerant, which is being returned from the evaporator to a suction chamber of the compression unit, to flow into the motor-driven compressor. More specifically, the part of the suction refrigerant first flows into an armature chamber of the electric motor, then passes through a swash plate chamber, that is, a crank chamber of the compression unit, and returns to the suction chamber. This suction refrigerant flow serves to cool the electric motor as well as the compression unit, thereby preventing overheating of the electric motor and the compression unit.

However, after the refrigerant is used for cooling, the temperature thereof is high since the refrigerant has absorbed the heat of the electric motor and compression unit. If such high-temperature refrigerant is returned to the suction chamber, the temperature of the suction refrigerant to be compressed by the compression unit undesirably increases, and the increase in the temperature of the suction refrigerant significantly lowers the refrigerant compression efficiency of the compression unit, that is, the cooling power of the air conditioning system.

Also, when passing through the crank chamber of the compression unit for cooling same, the refrigerant carries off lubricating oil in the compression unit, with the result that the lubricating oil in the compression unit runs short, hindering smooth operation of the compression unit.

SUMMARY OF THE INVENTION

An object of the present invention is to provide a motor-driven compressor which is capable of preventing a suction refrigerant from being excessively heated and also maintaining smooth operation of a compression unit and yet ensures satisfactory cooling of an electric motor.

The present invention is applied to a motor-driven compressor which is incorporated in an air conditioning system, for compressing and supplying a refrigerant to a refrigerant circuit of the air conditioning system, and receiving the refrigerant from the refrigerant circuit after the refrigerant is used for cooling. The motor-driven compressor of the present invention comprises: an electric motor including a motor housing defining an armature chamber therein, and an armature housed in the armature chamber; a compression unit driven by the electric motor, the compression unit including a unit housing in which are defined a suction chamber for receiving the refrigerant from the refrigerant circuit, a discharge chamber for supplying the compressed refrigerant to the refrigerant circuit, and a rotor chamber accommodating a rotating member rotated by the electric motor, and a compression mechanism housed in the unit housing, the compression mechanism compressing the refrigerant sucked therein from the suction chamber and discharging the compressed refrigerant to the discharge chamber as the rotating member rotates; and a cooling channel for guiding the refrigerant returned from the refrigerant circuit to the suction chamber, the cooling channel including the armature chamber, and a downstream section extending from the armature chamber to the suction chamber in such a manner that the downstream section is separated from the rotor chamber.

With this motor-driven compressor, low-temperature refrigerant returned from the refrigerant circuit flows into the armature chamber of the electric motor, thus effectively cooling the electric motor. The refrigerant then flows to the suction chamber through the downstream section of the cooling channel which is separated from the rotor chamber of the compression unit, and thus the refrigerant is not excessively heated by the heat in the compression unit while passing through the downstream section. Accordingly, the refrigerant to be sucked into the compression unit is kept from being heated to an undesirably high temperature, thus preventing lowering of the refrigerant compression efficiency of the compression unit, that is, the cooling power of the air conditioning system.

Further, since the refrigerant does not flow into the rotor chamber of the compression unit, the lubricating oil in the compression mechanism is never carried away by the refrigerant in the rotor chamber. It is therefore possible to prevent the lubricating oil in the compression mechanism from running short.

Specifically, the armature of the electric motor has a motor shaft extending through the rotor chamber, and the compression mechanism includes a swash plate arranged in the rotor chamber and rotated by the motor shaft, and a plurality of pistons reciprocated by rotation of the swash plate to perform a refrigerant suction stroke and a refrigerant compression stroke.

In this case, the cooling channel includes an upstream section connecting between the refrigerant circuit and the armature chamber and having an inlet port formed in the motor housing. Preferably, the inlet port is located near an end wall of the motor housing which is located opposite the unit housing.

The downstream section of the cooling channel may include any one of an axial passage formed in a peripheral wall of the unit housing and extending parallel with the motor shaft, a pipe member extending through the rotor chamber of the unit housing in parallel with the motor shaft, and an internal passage formed in the motor shaft.

Further, the downstream section of the cooling channel may include an external pipe extending outside of the unit housing. In this case, the external pipe connects between an outlet port formed in the motor housing and communicating with the armature chamber and a second inlet port formed in the unit housing and communicating with the suction chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
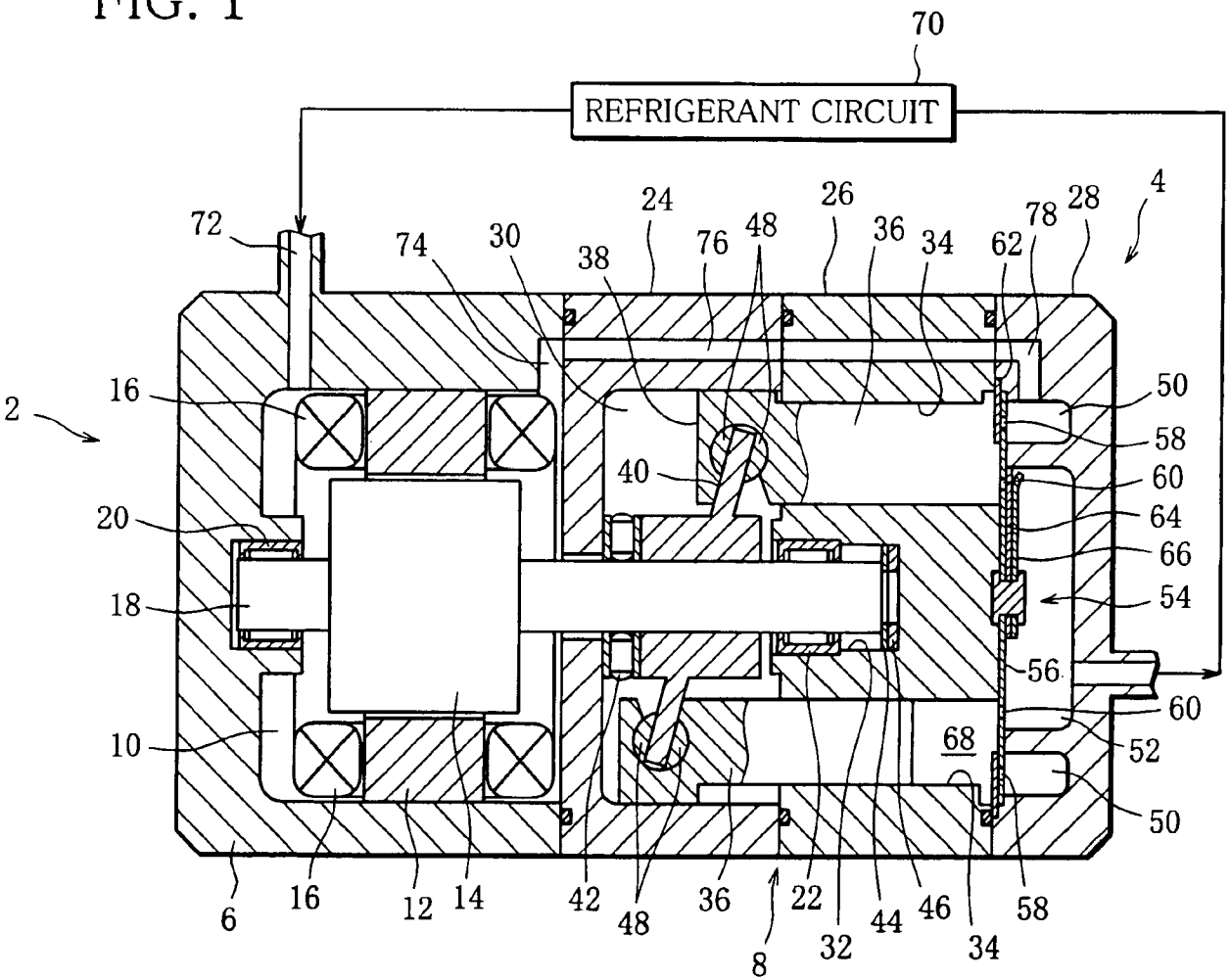
FIG. 1 is a longitudinal sectional view of a motor-driven compressor according to a first embodiment.

A motor-driven compressor according to a first embodiment, shown in FIG. 1, is incorporated in an air conditioning system of a motor vehicle and is used to compress a refrigerant in the air conditioning system. The motor-driven compressor generally comprises an electric motor 2 and a compression unit 4, and the compression unit 4 has a swash plate-type compression mechanism.

The electric motor 2 has a motor housing 6, in which an armature chamber 10 is defined in cooperation with a unit housing 8 of the compression unit 4. More specifically, the motor housing 6 and the unit housing 8 are coupled together in close contact with each other, and the motor housing 6 is in the form of a hollow cylinder closed at one end and opening at the other and facing the unit housing 8.

The armature chamber 10 accommodates a stator 12, a rotor 14 and numerous coils 16, and the rotor 14 is mounted to a motor shaft 18. The motor shaft 18 is rotatably supported at one end by an end wall of the motor housing 6 through a radial bearing 20. The other end of the motor shaft 18 extends from the armature chamber 10 into the unit housing 8 and is rotatably supported by the unit housing 8 through a radial bearing 22.

The unit housing 8 includes a crank casing 24, a cylindrical cylinder block 26 and a cylinder head 28 arranged in the order mentioned from the side of the motor housing 6. The armature chamber 10 is defined between the motor housing 6 and one end face of the crank casing 24.

The crank casing 24 defines therein a crank chamber 30 in cooperation with one end face of the cylinder block 26. The aforementioned motor shaft 18 extends through the crank chamber 30, and the other end thereof is inserted into a bearing hole 32 of the cylinder block 26 and supported by the hole 32 through the radial bearing 22, that is, by the cylinder block 26. The bearing hole 32 is formed in the center of the cylinder block 26.

The cylinder block 26 has, for example, two cylinder bores 34 formed therein and separated from each other in a diametrical direction of the cylinder block 26, and the bearing hole 32 is located between the cylinder bores 34. Each cylinder bore 34 extends through the cylinder block 26 in an axial direction thereof and receives a single head piston 36. The pistons 36 each have a tail 38 projecting into the crank chamber 30.

A swash plate 40 is arranged in the crank chamber 30 and mounted to the motor shaft 18. Accordingly, as the electric motor 2 is driven, the swash plate 40 rotates together with the motor shaft 18.

A thrust bearing 42 is fitted on the motor shaft 18 and is located between the swash plate 40 and an inner wall surface of the crank casing 24. Further, a washer bearing 44 and a belleville spring 46 are arranged between the other end of the motor shaft 18 and the bottom of the bearing hole 32. The belleville spring 46 pushes the motor shaft 18 toward the thrust bearing 42, whereby the swash plate 40 is positioned with respect to the axial direction of the motor shaft 18.

The tail 38 of each piston 36 has a pair of shoes 48, between which is slidably held an outer peripheral edge of the swash plate 40. Accordingly, as the swash plate 40 rotates, each piston 36 is reciprocated by the swash plate 40 over a predetermined stroke which is determined by an inclination angle of the swash plate 40.

The cylinder head 28 defines therein a suction chamber 50 and a discharge chamber 52 in cooperation with the other end face of the cylinder block 26. The discharge chamber 52 is located in a central portion of the cylinder head 28, while the suction chamber 50 is in the form of an annulus surrounding the discharge chamber 52 and is supplied with the refrigerant, as described later.

A valve assembly 54 is interposed between the other end face of the cylinder block 26 and the cylinder head 28. More specifically, the valve assembly 54 has a valve plate 56 for blocking the communication between the cylinder bores 34 and the suction chamber 50 and the communication between the cylinder bores 34 and the discharge chamber 52.

Also, the valve plate 56 has a suction port 58 and a discharge port 60 associated with each of the cylinder bores 34. The suction port 58 permits the corresponding cylinder bore 34 to communicate with the suction chamber 50 and is opened and closed by a suction valve 62. The discharge port 60 permits the corresponding cylinder bore 34 to communicate with the discharge chamber 52 and is opened and closed by a discharge valve 64.

Specifically, the suction and discharge valves 62 and 64 are each constituted by a reed valve. Each suction valve 62 is so arranged as to close the corresponding suction port 58 from inside the cylinder bore 34, and each discharge valve 64 is so arranged as to close the corresponding discharge port 60 from inside the discharge chamber 52. The valve assembly 54 further includes a valve stopper 66 for regulating the opening of the discharge valve 64.

FIG. 1 illustrates only one discharge valve 64 for opening and closing the corresponding discharge port 60 and the valve stopper 66 associated therewith.

When the piston 36 moves in a direction away from the suction and discharge chambers 50 and 52 as the swash plate 40 rotates, the volume of a compression chamber 68 defined between the head of the piston 36 and the valve plate 56 increases, and thus the suction valve 62 opens, allowing the refrigerant in the suction chamber 50 to be introduced into the compression chamber 68 through the suction port 58.

On the other hand, when the piston 36 moves in a direction such that the volume of the compression chamber 68 decreases, the refrigerant in the compression chamber 68 is pressurized. When the refrigerant pressure thereafter exceeds the valve closing force of the discharge valve 62, the discharge valve 62 opens, so that the high-pressure refrigerant is discharged from the compression chamber 68 into the discharge chamber 52 through the discharge port 60.

The high-pressure refrigerant in the discharge chamber 52 is then supplied to a refrigerant circuit 70 of the air conditioning system and used to cool the interior of the vehicle compartment of the motor vehicle. The air conditioning system includes a condenser, an expansion valve, an evaporator, etc., and the discharge chamber 52 is connected to the inlet of the refrigerant circuit 70, that is, the condenser.

The aforementioned suction chamber 50 is usually connected to the outlet of the refrigerant circuit 70, that is, the evaporator. As distinct from such arrangement, the motor-driven compressor of the first embodiment has a cooling channel formed therein and connecting between the suction chamber 50 and the evaporator of the refrigerant circuit 70. The cooling channel is formed in the motor housing 6 and the unit housing 8 and includes the armature chamber 10 of the motor housing 6.

More specifically, the cooling channel has an inlet port 72 formed in the peripheral wall of the motor housing 6. The inlet port 72 is located near the end wall of the motor housing 6 and connects the evaporator and the armature chamber 10 of the motor housing 6 to each other.

The motor housing 6 is open at the other end and faces the unit housing 8, as mentioned above, and a radial groove 74 is formed in the other end face of the motor housing 6 so as to extend from the armature chamber 10 radially outward of the motor housing 6.

An axial passage 76 is formed in the outer peripheral portion of the unit housing 8. The axial passage 76 extends parallel with the axis of the unit housing 8 and penetrates through the crank casing 24 and the cylinder block 26. One end of the axial passage 76 is connected to the radial groove 74, and the other end of same opens in the other end face of the cylinder block 26.

An L-shaped passage 78 is formed in the outer peripheral portion of the cylinder head 28 and connects the other end of the axial passage 76 and the suction chamber 50 to each other.

With the cooling channel formed as described above, the refrigerant returned from the evaporator of the refrigerant circuit 70 first flows into the armature chamber 10 through the inlet port 72. Subsequently, the refrigerant in the armature chamber 10 is supplied to the suction chamber 50 through the radial groove 74, axial passage 76 and L-shaped passage 78.

The refrigerant returned from the evaporator is low in temperature, and also the inlet port 72 and the radial groove 74 are located on opposite sides of the armature (stator 12, rotor 14, etc.) as viewed in the axial direction thereof. Accordingly, the refrigerant introduced into the armature chamber 10 from the inlet port 72 diffuses throughout the armature chamber 10 and then flows out via the radial groove 74. The refrigerant in the armature chamber 10 can therefore effectively cool the electric motor 2, thereby preventing the motor 2 from being overheated. In consequence, even if the electric motor 2 is rotated at high speed for a long time, lowering of the rotation efficiency of the motor 2 does not occur.

The refrigerant in the armature chamber 10 is guided to the suction chamber 50 through the radial groove 74, axial passage 76 and L-shaped passage 78 and does not flow into the crank chamber 30. Accordingly, the refrigerant being guided to the suction chamber 50 absorbs little heat generated in the crank chamber 30 (heat generated due to the sliding contact between the swash plate 40 and the shoes 48 of the pistons 36 and heat generated due to the sliding contact between each piston 36 and the inner peripheral surface of the corresponding cylinder bore 34). As a result, the refrigerant sucked into the compression chambers 68 from the suction chamber 50 can be kept from being excessively heated, thus preventing lowering of the refrigerant compression efficiency of the compression unit 4, that is, the cooling power of the air conditioning system.

Further, since the refrigerant does not flow into the crank chamber 30, a situation where the refrigerant carries away the lubricating oil present between the swash plate 40 and the shoes 48 or between each piston 36 and the inner peripheral surface of the corresponding cylinder bore 34 does not occur. Accordingly, the lubricating oil is prevented from running short, thus ensuring smooth rotation of the swash plate 40 as well as smooth reciprocating motion of the pistons 36.

Figure 2:
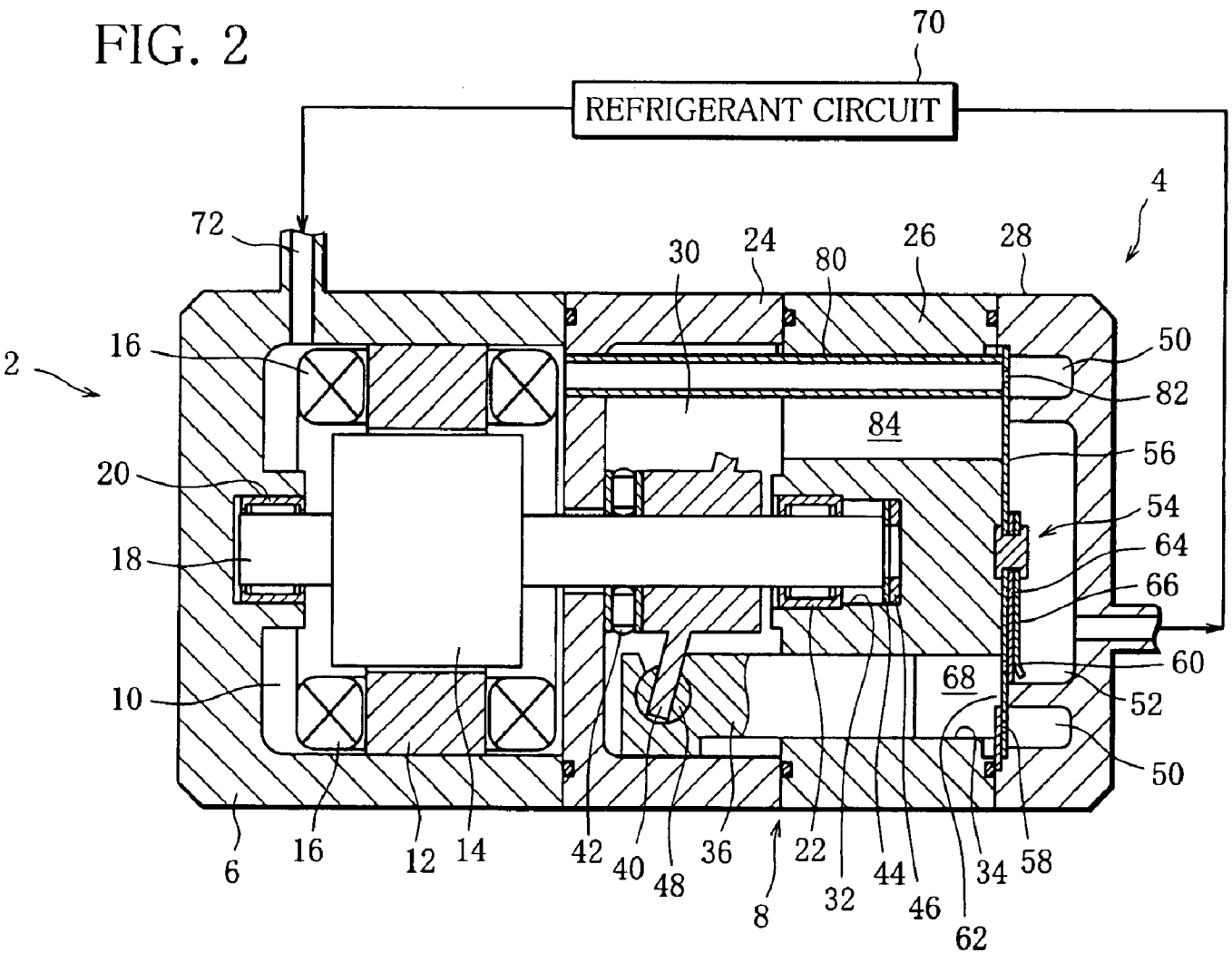
FIG. 2 is a longitudinal sectional view of a motor-driven compressor according to a second embodiment.
Figure 3:
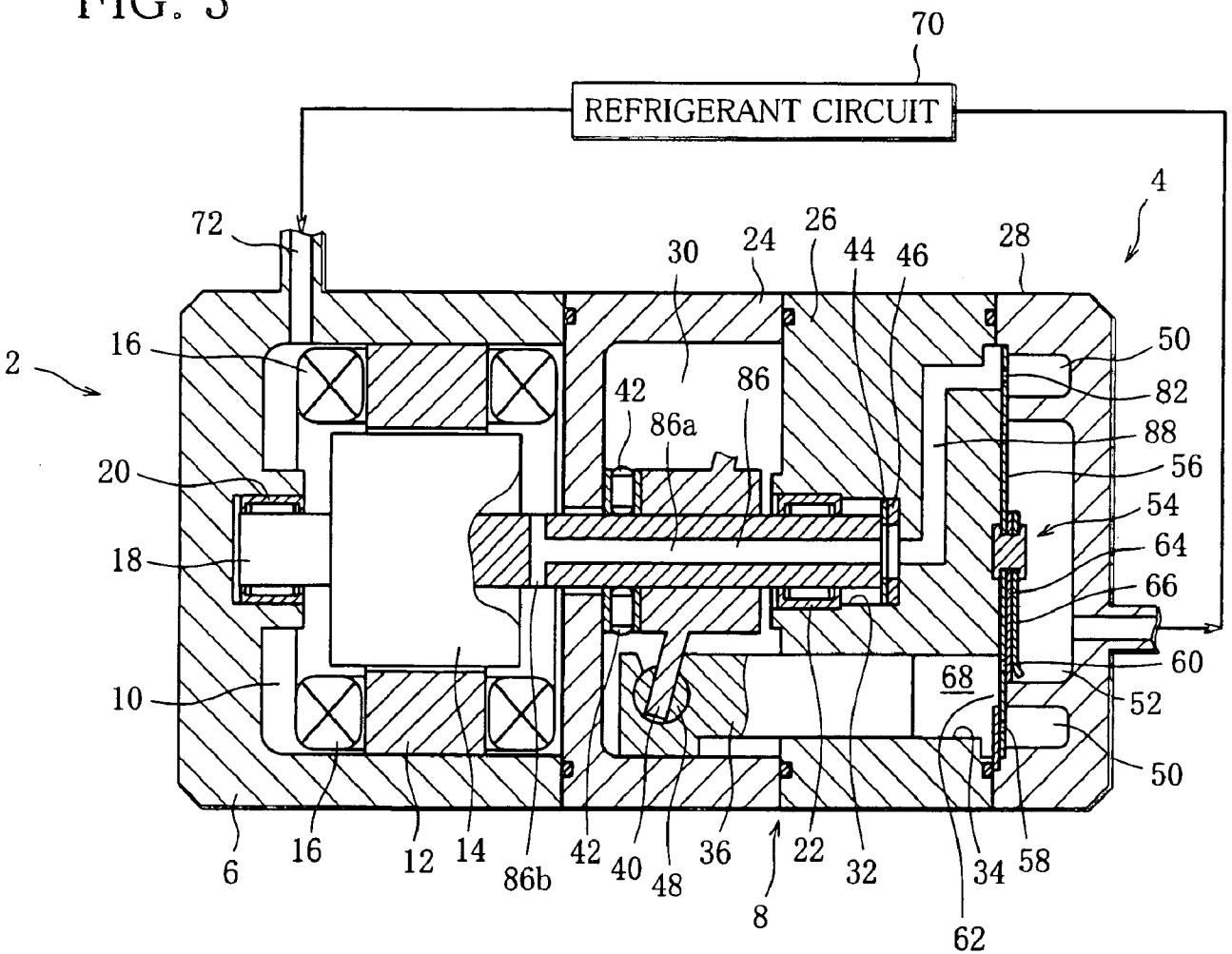
FIG. 3 is a longitudinal sectional view of a motor-driven compressor according to a third embodiment.
Figure 4:
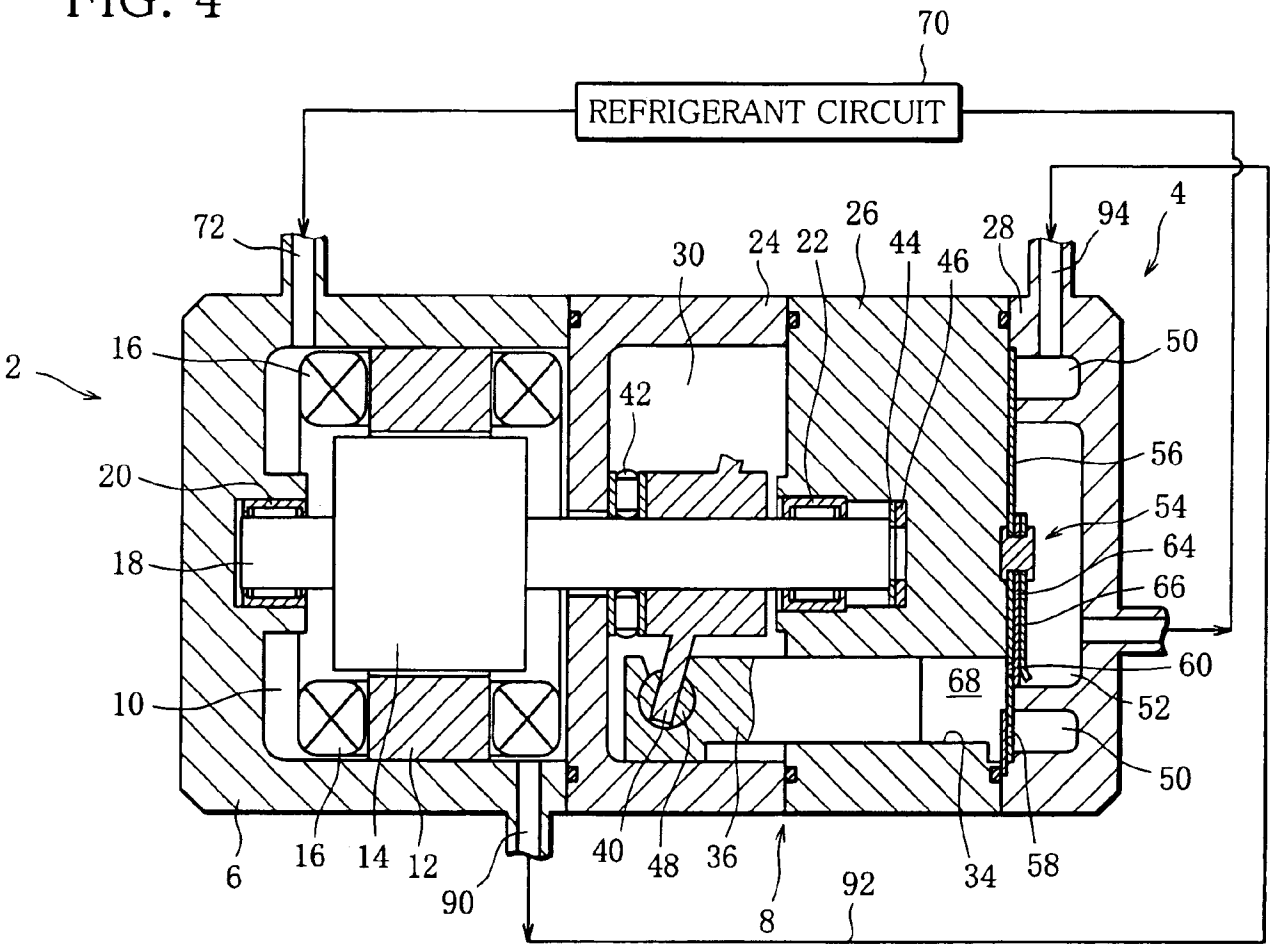
FIG. 4 is a longitudinal sectional view of a motor-driven compressor according to a fourth embodiment.

The present invention is not limited to the first embodiment described above and can be modified in various ways. FIGS. 2 to 4 respectively illustrate motor-driven compressors according to second to fourth embodiments of the present invention.

In the following description of the second to fourth embodiments, identical reference numerals are used to denote members or parts having the same functions as those explained above with reference to the motor-driven compressor of the first embodiment, and description of such members or parts is omitted.

The cooling channel of the second embodiment, shown in FIG. 2, includes a refrigerant pipe 80, in place of the radial groove 74 and the axial passage 76. The refrigerant pipe 80 extends through the crank casing 24 and the cylinder block 26 from the one end face of the crank casing 24 to the other end face of the cylinder block 26. One end of the refrigerant pipe 80 opens into the armature chamber 10, and the other end of same is connected to an outlet 82, in place of the L-shaped passage 78. The outlet 82 is formed through the valve plate 56 to connect the refrigerant pipe 80 and the suction chamber 50 to each other. As clearly shown in FIG. 2, a through hole 84 for passing the refrigerant pipe 80 therethrough is formed in the cylinder block 26 and is located between the cylinder bores 34 as viewed in the circumferential direction of the cylinder block 26.

In the second embodiment, the refrigerant returned from the refrigerant circuit 70 flows into the suction chamber 50 through the inlet port 72, armature chamber 10, refrigerant pipe 80 and outlet 82.

The cooling channel of the third embodiment shown in FIG. 3 includes, in place of the refrigerant pipe 80 of the second embodiment, an internal passage 86 extending through the motor shaft 18 and an internal passage 88 formed in the cylinder block 26. The internal passage 86 has an axial passage 86*a* extending along the axis of the motor shaft 18 and radial holes 86*b* connecting one end of the axial passage 86*a* with the armature chamber 10, the other end of the axial passage 86*a* opening in the other end face of the motor shaft 18. On the other hand, the internal passage 88 has one end opening in the bottom surface of the bearing hole 32 of the cylinder block 26 and the other end communicating with the outlet 82. Needless to say, the internal passage 88 is formed so as not to interfere with the cylinder bores 34.

In the third embodiment, the refrigerant returned from the refrigerant circuit 70 flows into the suction chamber 50 through the inlet port 72, armature chamber 10, internal passage 86, holes in the bearing 44 and belleville spring 46, internal passage 88 and outlet 82.

The cooling channel of the fourth embodiment, shown in FIG. 4, has an upstream section including the inlet port 72 and the armature chamber 10, and a downstream section extending from the armature chamber 10 to the suction chamber 50. Unlike the first to third embodiments, the downstream section of the cooling channel is formed outside of the unit housing 8.

More specifically, the downstream section of the cooling channel has an outlet port 90 formed in the outer peripheral wall of the motor housing 6. The outlet port 90 is located near the one end wall of the crank casing 24 and connects the armature chamber 10 and an external pipe 92 to each other. The external pipe 92 extends outside of the unit housing 8 and is connected to an inlet port 94 of the cylinder head 28. The inlet port 94 is formed in the outer peripheral wall of the cylinder head 28 and connects the external pipe 92 and the suction chamber 50 to each other.

In the fourth embodiment, the refrigerant returned from the refrigerant circuit 70 flows into the suction chamber 50 through the inlet port 72, armature chamber 10, outlet port 90, external pipe 92 and inlet port 94.

Like the first embodiment, the cooling channels of the second to fourth embodiments serve to guide the refrigerant into the armature chamber 10 and then to the suction chamber 50 without introducing the refrigerant into the crank chamber 30. Also with the cooling channels of the second to fourth embodiments, therefore, the electric motor 2 can be effectively cooled by the refrigerant. Further, the refrigerant, which has been used for cooling, is neither excessively heated by the heat in the crank chamber 30 nor carries away the lubricating oil in the compression unit 4.

In the first to fourth embodiments described above, a swash plate-type compression mechanism having single head pistons is built into the compression unit. It should, however, be noted that the present invention is also applicable to other motor-driven compressors having various types of compression unit coupled to an electric motor.

What is claimed is:

1. A motor-driven compressor incorporated in an air conditioning system, for compressing and supplying a refrigerant to a refrigerant circuit of the air conditioning system, and receiving the refrigerant from the refrigerant circuit after the refrigerant is used for cooling, said motor-driven compressor comprising:

an electric motor including a motor housing defining an armature chamber therein, and an armature housed in the armature chamber;

a compression unit driven by said electric motor, said compression unit including a unit housing in which are defined a suction chamber for receiving the refrigerant from the refrigerant circuit, a discharge chamber for supplying the compressed refrigerant to the refrigerant circuit, and a rotor chamber accommodating a rotating member rotated by said electric motor, and a compression mechanism housed in the unit housing, the compression mechanism compressing the refrigerant sucked therein from the suction chamber and discharging the compressed refrigerant to the discharge chamber as the rotating member rotates; and a cooling channel for guiding the refrigerant returned from the refrigerant circuit to the suction chamber, said cooling channel including the armature chamber, and a downstream section extending from the armature chamber to the suction chamber in such a manner that the downstream section is separated from the rotor chamber.

2. The motor-driven compressor according to claim 1, wherein the armature of said electric motor has a motor shaft extending through the rotor chamber, and said compression mechanism includes a swash plate arranged in the rotor chamber and rotated by the motor shaft, and a plurality of pistons reciprocated by rotation of the swash plate to perform a refrigerant suction stroke and a refrigerant compression stroke.

3. The motor-driven compressor according to claim 2, wherein said cooling channel includes an upstream section connecting between the refrigerant circuit and the armature chamber and having an inlet port formed in the motor housing.

4. The motor-driven compressor according to claim 3, wherein said inlet port is located near an end wall of the motor housing which is located opposite the unit housing.

5. The motor-driven compressor according to claim 3, wherein said unit housing has a peripheral wall surrounding the rotor chamber and the compression mechanism, and the downstream section of said cooling channel includes an axial passage formed in the peripheral wall of the unit housing and extending parallel with the motor shaft.

6. The motor-driven compressor according to claim 5, wherein said motor housing and said unit housing are coupled together in close contact with each other, and the downstream section of said cooling channel further includes a connection passage formed in the motor housing and connecting between the armature chamber and the axial passage.

7. The motor-driven compressor according to claim 3, wherein the downstream section of said cooling channel includes a pipe member extending inside the unit housing in parallel with the motor shaft.

8. The motor-driven compressor according to claim 7, wherein said pipe member has a portion extending through the rotor chamber.

9. The motor-driven compressor according to claim 3, wherein the downstream section of said cooling channel includes an internal passage formed in the motor shaft.

10. The motor-driven compressor according to claim 9, wherein the downstream section of said cooling channel further includes a connection passage formed in the unit housing and connecting between the internal passage and the suction chamber.

11. The motor-driven compressor according to claim 3, wherein the downstream section of said cooling channel includes an outlet port formed in the motor housing and communicating with the armature chamber, a second inlet port formed in the unit housing and communicating with the suction chamber, and an external pipe connecting between the outlet port and the second inlet port, said external pipe extending outside of the unit housing.

* * * * *